US010509358B2

(12) United States Patent
Kashiwakura

(10) Patent No.: US 10,509,358 B2
(45) Date of Patent: Dec. 17, 2019

(54) IMAGE FORMATION APPARATUS INCLUDING LUBRICANT APPLICATION APPARATUS AND RECORDING MEDIUM

(71) Applicant: KONICA MINOLTA, INC., Tokyo (JP)

(72) Inventor: Kuniaki Kashiwakura, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/244,351

(22) Filed: Jan. 10, 2019

(65) Prior Publication Data

US 2019/0219961 A1 Jul. 18, 2019

(30) Foreign Application Priority Data

Jan. 12, 2018 (JP) ..... 2018-003071

(51) Int. Cl.
*G03G 21/00* (2006.01)
*G03G 15/00* (2006.01)
*G03G 21/10* (2006.01)

(52) U.S. Cl.
CPC ..... *G03G 21/0094* (2013.01); *G03G 15/5004* (2013.01); *G03G 21/0011* (2013.01); *G03G 21/0035* (2013.01); *G03G 21/10* (2013.01); *G03G 2221/0005* (2013.01)

(58) Field of Classification Search
CPC ..... G03G 21/0011; G03G 21/0035; G03G 21/0094; G03G 21/10; G03G 15/5004; G03G 2221/0005
USPC ..... 399/346
See application file for complete search history.

(56) References Cited

U.S. PATENT DOCUMENTS

2010/0074634 A1* 3/2010 Ohno ..... G03G 21/0035 399/12
2011/0052287 A1* 3/2011 Kashiwakura ..... G03G 21/0094 399/346
2011/0206430 A1* 8/2011 Arai ..... G03G 21/0094 399/346
2012/0321363 A1* 12/2012 Nakane ..... G03G 21/0035 399/346

(Continued)

FOREIGN PATENT DOCUMENTS

JP 2009042295 A 2/2009

*Primary Examiner* — Sophia S Chen
(74) *Attorney, Agent, or Firm* — Buchanan Ingersoll & Rooney PC

(57) ABSTRACT

An image formation apparatus having a lubricant application apparatus applying lubricant to an image carrier in an image former, in which the lubricant application apparatus includes: a lubricant stick; an application member disposed on an upstream side in an advancing direction of the image carrier surface with respect to a cleaning apparatus pressing lubricant supplied to the image carrier to form a film, supplying lubricant scraped off from the lubricant stick to the image carrier, and removing residual toner adhering to the image carrier; and a recovery member in contact with the application member, and recovering toner adhering to the application member, and the image formation apparatus includes a hardware processor controlling a lubricant amount on the image carrier by changing each of removability of residual toner on the image carrier by the application member, and recoverability of residual toner on the application member by the recovery member.

9 Claims, 5 Drawing Sheets

(56) References Cited

U.S. PATENT DOCUMENTS

| | | | | |
|---|---|---|---|---|
| 2013/0034375 | A1* | 2/2013 | Kashiwakura ..... | G03G 21/0017 399/350 |
| 2013/0195528 | A1* | 8/2013 | Noguchi ..... | G03G 21/0011 399/346 |
| 2015/0153704 | A1* | 6/2015 | Nishisaka ..... | G03G 21/0094 399/346 |

* cited by examiner

IMAGE FORMATION APPARATUS INCLUDING LUBRICANT APPLICATION APPARATUS AND RECORDING MEDIUM

The entire disclosure of Japanese Patent Application No. 2018-003071, filed on 12 Jan. 2018, is incorporated herein by reference in its entirety.

BACKGROUND

Technical Field

The present invention relates to an image formation apparatus including a lubricant application apparatus, and a recording medium.

Description of the Related Art

Conventionally, a technique has been known which applies lubricant to a photoreceptor in order to enhance cleanability of toner and reduce depletion of the film thickness of the photoreceptor. Specifically, a brush (application brush) which abuts on the photoreceptor to rotate is brought into pressure contact with the lubricant which is a solid made of zinc stearate to scrape off the lubricant, and carries the lubricant to the photoreceptor as it is for supply to the photoreceptor. Lubricant powder supplied to the photoreceptor is spread by a rubber blade (cleaning blade) disposed downstream thereof, so that a film is formed on the photoreceptor to be a lubricant layer.

It is desired to increase or decrease the lubricant amount on the photoreceptor depending on the state of an image formation unit. For example, at the end of the life of the image formation unit, progress of wear of the cleaning blade facilitates slipping-through of toner or an external additive, so it is effective to further increase the lubricant amount to suppress slipping-through of them. In addition, in an environment at high temperature and high humidity in which image deletion is likely to occur, image deletion can be effectively suppressed by reducing the lubricant amount and scraping away discharge products which are substances responsible for image deletion for refreshment.

In the case of upstream application in which the application brush is disposed on the upstream side in the rotation direction of the photoreceptor with respect to the cleaning blade, control of the lubricant amount can be implemented by controlling removability of the application brush, that is, the amount of toner reaching the cleaning blade, and recoverability, that is, the dirt state of the application brush. As a method of controlling the removability and the recoverability, there is a method of controlling voltage applied to the application brush. For example, Japanese Patent Application Laid-Open Publication No. 2009-042295 discloses a technique in which in a lubricant application apparatus having an application brush, and a recovery roller which rotates in contact with the application brush to recover toner adhering to the application brush, voltage having polarity reverse to that of toner is applied to the application brush, and voltage for forming a recovery electric field for recovering toner from the application brush is applied to the recovery roller. The above configuration improves the removability of the application brush, so that toner adhering to the application brush is reliably removed. As a result, the recoverability of the recovery roller improves, so that it is possible to reduce the amount of toner reaching the cleaning blade.

However, in the method disclosed in Japanese Patent Application Laid-Open Publication No. 2009-042295, it is difficult to perform control so that the amount of toner reaching the cleaning blade may increase. Since insufficiency of the amount of toner reaching the cleaning blade decreases efficiency of removal of lubricant by the cleaning blade, lubricant becomes excessive on the photoreceptor. Furthermore, in a method of uniformly controlling voltages applied to the application brush and the recovery roller, it is difficult to perform control depending on the environment, for example, when it is desired to decrease the lubricant amount on the photoreceptor under a condition of high temperature and high humidity.

SUMMARY

The present invention is made in consideration of the above problem, and is to provide an image formation apparatus including a lubricant application apparatus and a recording medium which keep a lubricant amount on a photoreceptor to an appropriate amount depending on durability, an usage environment, or the like of an image former to ensure stable cleanability of the image former over a long period of time, thereby achieving a long life.

To achieve at least one of the abovementioned objects, according to a first aspect of the present invention, an image formation apparatus reflecting one aspect of the present invention comprises an image formation apparatus having a lubricant application apparatus which applies lubricant to an image carrier in an image former which forms a toner image, in which the lubricant application apparatus includes:

a lubricant stick obtained by solidifying powdery lubricant;

an application member disposed on an upstream side in an advancing direction of a surface of the image carrier with respect to a cleaning apparatus which presses lubricant supplied to the image carrier to form a film, the application member being for supplying lubricant scraped off from the lubricant stick to the image carrier and removing residual toner adhering to the image carrier; and a recovery member which is in contact with the application member, the recovery member being for recovering toner adhering to the application member, and the image formation apparatus includes a hardware processor which controls a lubricant amount on the image carrier by changing each of removability of residual toner on the image carrier by the application member, and recoverability of residual toner on the application member by the recovery member.

According to a second aspect of the present invention, a computer readable recording medium reflecting one aspect of the present invention comprises a non-transitory computer readable recording medium storing a program for causing a computer of an image formation apparatus including a lubricant application apparatus which includes: a lubricant stick obtained by solidifying powdery lubricant; an application member which supplies lubricant scraped off from the lubricant stick to the image carrier, and removes residual toner adhering to the image carrier; and a recovery member which is in contact with the application member, the recovery member being for recovering toner adhering to the application member, the lubricant application apparatus being disposed on an upstream side in an advancing direction of a surface of the image carrier with respect to a cleaning apparatus which presses lubricant supplied to the image carrier to form a film, to control a lubricant amount on the image carrier by changing each of removability of residual toner on the image carrier by the application member, and recoverability of residual toner on the application member by the recovery member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiment of the present invention will be described with reference to the drawings. However, the scope of the invention is not limited to the disclosed embodiments.

Embodiments of the present invention will be described below in detail with reference to the drawings.

[Configuration of Image Formation Apparatus]

Figure 1:
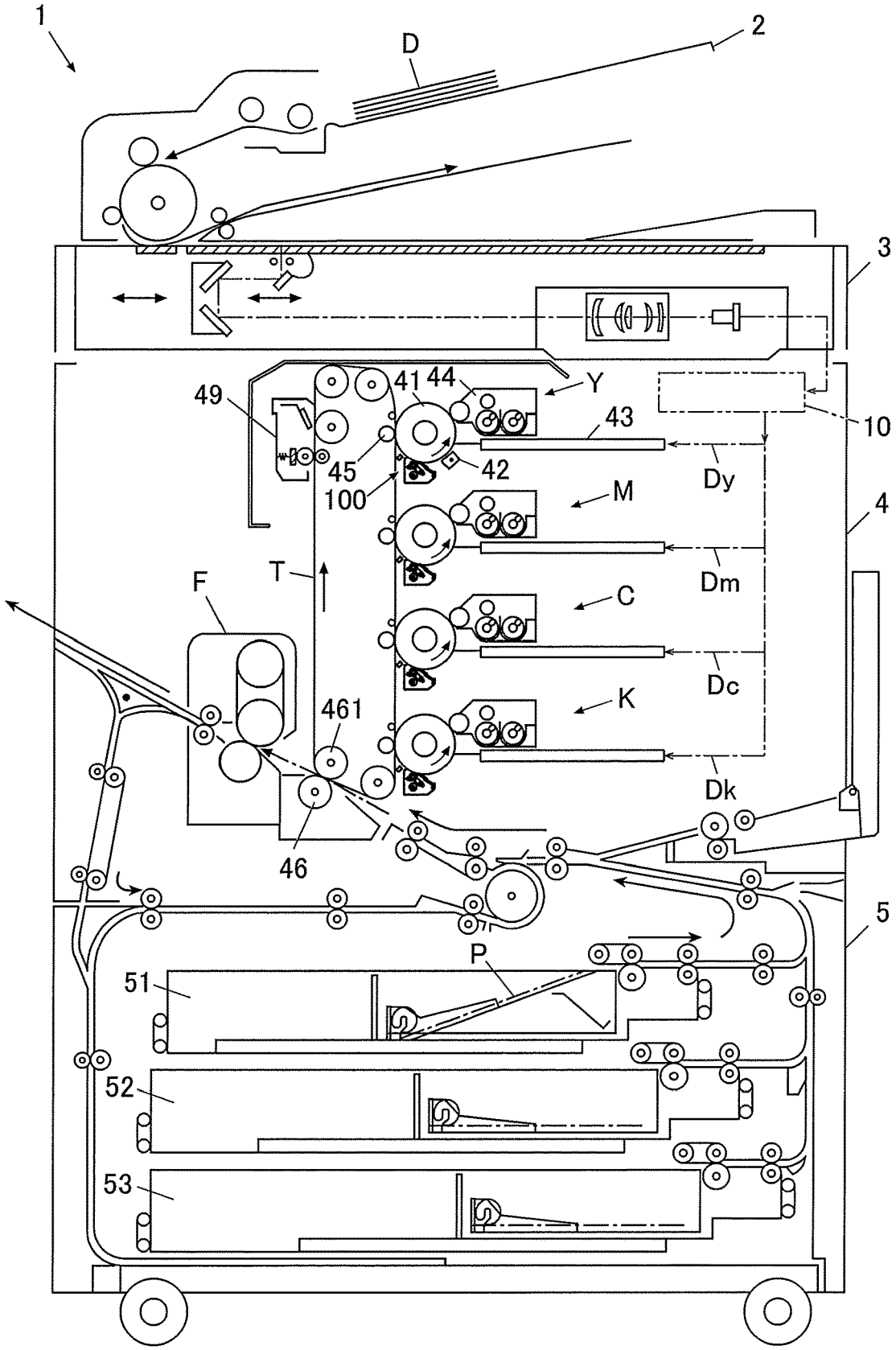
FIG. 1 is a diagram showing a schematic configuration of an image formation apparatus according to this embodiment.
Figure 2:
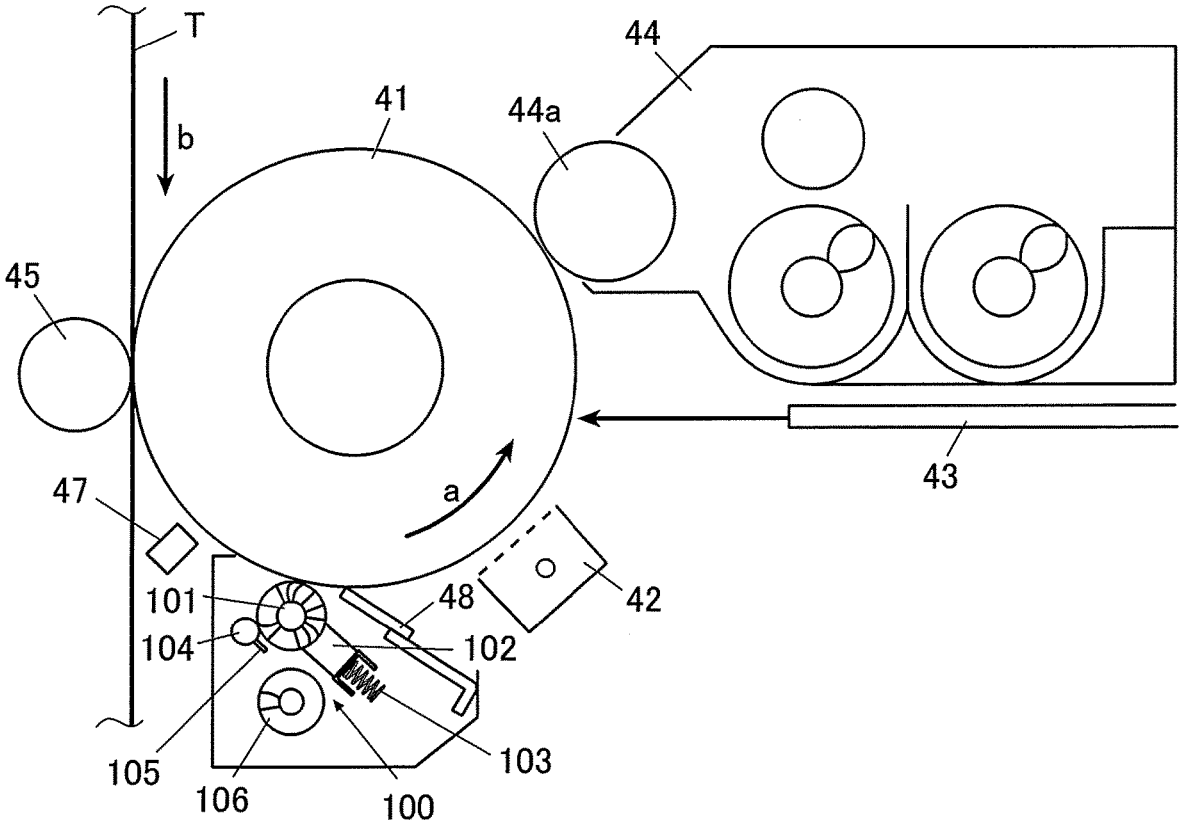
FIG. 2 is a diagram showing a schematic configuration of an image former.
Figure 3:
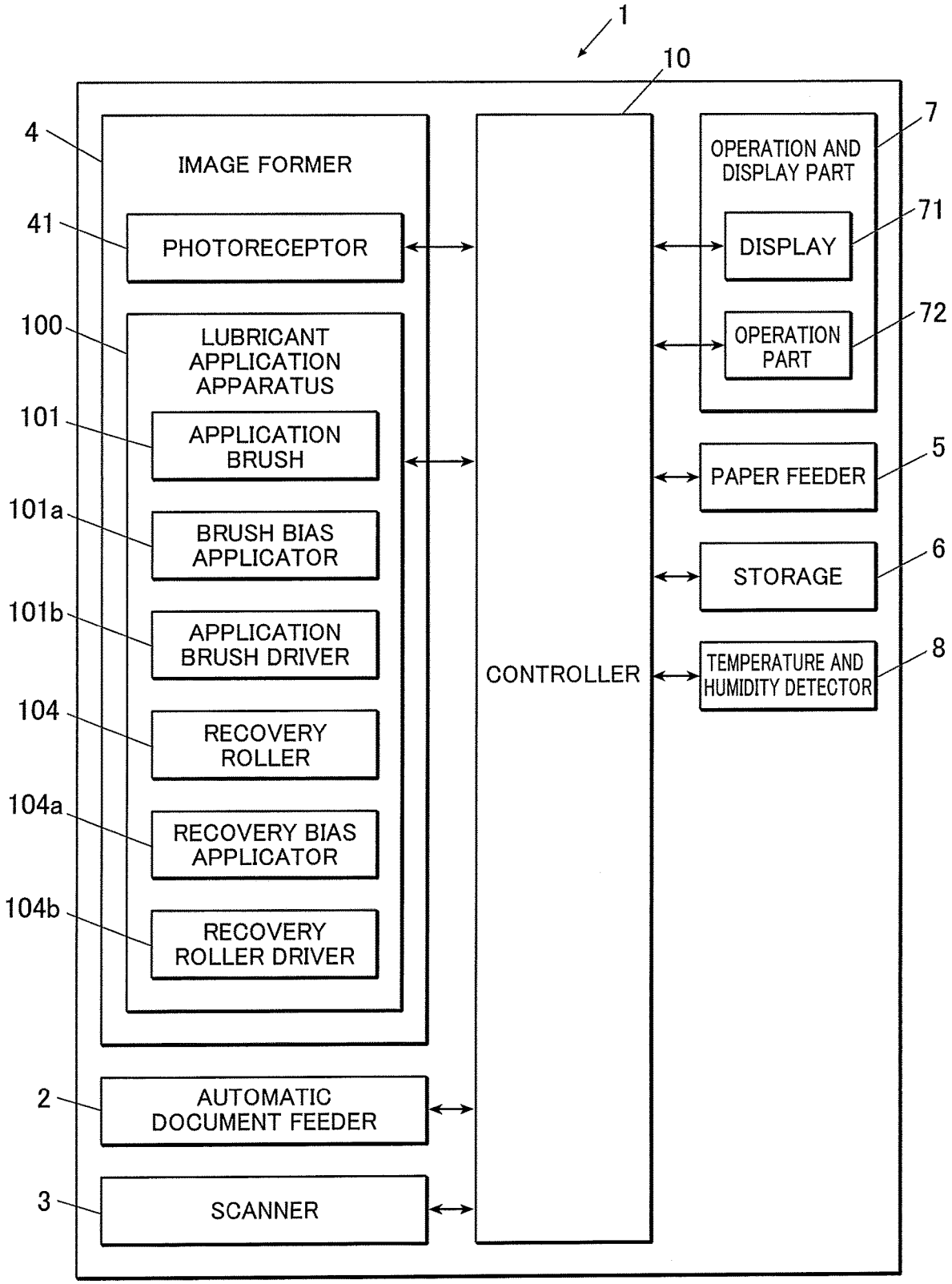
FIG. 3 is a functional block diagram showing a control structure of the image formation apparatus according to this embodiment.

An image formation apparatus 1 according to this embodiment is an intermediate transfer-type color image formation apparatus using electrophotographic process technology, and as shown in FIGS. 1-3, is composed of an automatic document feeder 2, a scanner 3, an image former 4, a paper feeder 5, a storage 6, an operation and display part 7, a temperature and humidity detector 8, and a controller 10.

The automatic document feeder 2 is composed of a placement tray on which a document D is placed, and a mechanism, a carrying roller, and the like which carry the document D, and carries the document D to a predetermined carrying path.

The scanner 3 is composed of an optical system such as a light source, a reflection mirror, and the like, and illuminates the document D carried in the predetermined carrying path or a document D placed on a platen glass with the light source to receive reflection light. In addition, the scanner 3 converts the received reflection light into an electric signal for output to the controller 10.

The image former 4 is composed of a yellow image former Y, a magenta image former M, a cyan image former C, a black image former K, an intermediate transfer belt T, and a fixing apparatus F.

The respective image formers YMCK form yellow, magenta, cyan, black toner images on photoreceptors 41, and primarily transfer the toner images of respective YMCK colors formed on the photoreceptors 41 onto the intermediate transfer belt T.

Note that since all configurations and operations of the respective image formers YMCK are the same, a series of image formation operations performed by the image former 4 will be described below taking the yellow image former Y as an example.

The photoreceptor (image carrier) 41 is composed of an organic photoreceptor obtained by forming a photosensitive layer made of a resin containing an organic photoconductor on the outer peripheral surface of a drum-like metallic base, and is rotationally driven in the "a" direction in the figure. Resins composing the photosensitive layer include, for example, a polycarbonate resin, a silicone resin, a polystyrene resin, an acrylic resin, a methacrylic resin, an epoxy resin, a polyurethane resin, a vinyl chloride resin, and a melamine resin.

An electrifying apparatus 42 uses an electrifying charger to electrify the photoreceptor 41 to a certain potential.

An exposure apparatus 43 exposes a non-image area of the photoreceptor 41 based on image data Dy from the controller 10 to remove electric charges in the exposed part, thereby forming an electrostatic latent image in an image area of the photoreceptor 41.

The developing apparatus 44 includes a developing sleeve 44*a* disposed facing the photoreceptor 41 via a development area. For example, DC development bias having the same polarity as charge polarity of the electrifying apparatus 42, or development bias obtained by superimposing DC voltage having the same polarity as charge polarity of the electrifying apparatus 42 on AC voltage is applied to the developing sleeve 44*a*, thereby supplying developer onto the electrostatic latent image formed on the photoreceptor 41 to form a yellow toner image on the photoreceptor 41. Note that the developer includes toner and a carrier for electrifying the toner. The toner is not limited in particular, and commonly used known toners are available. For example, a toner is available which is obtained by making a binder resin contain colorant and, if necessary, a charge control agent, a release agent, and the like, and process an external additive. A toner particle diameter is not limited in particular, but is preferably about 3 to 15 μm.

A primary transfer roller primarily transfers the yellow toner image formed on the photoreceptor 41 to the intermediate transfer belt T. Note that the other image formers MCK similarly primarily transfer magenta, cyan, and black toner images to the intermediate transfer belt T. Thereby, the color toner images of the respective YMCK colors are formed on the intermediate transfer belt T.

The intermediate transfer belt T is a semiconducting endless belt suspended and rotatably supported by a plurality of rollers, and is rotationally driven in the "b" direction in the figure with rotation of the rollers. This intermediate transfer belt T is crimped by the primary transfer rollers 45 to the respective facing photoreceptors 41. Transfer current corresponding to applied voltage flows through each of the primary transfer rollers 45. Thereby, each toner image developed on the surface of each photoreceptor 41 is primarily transferred by each primary transfer roller 45 to the intermediate transfer belt T sequentially.

A secondary transfer roller 46 is pressed onto the intermediate transfer belt T to rotate following it, thereby secondarily transferring the toner images of the respective YMCK colors transferred to the intermediate transfer belt T to be formed thereon onto a paper sheet P carried from paper feeding trays 51-53 in the paper feeder 5. The secondary transfer roller 46 is disposed to abut on a secondary transfer facing roller 461 via the intermediate transfer belt T, and the paper sheet P passes through a transfer nip formed between the secondary transfer roller 46 and the secondary transfer facing roller 461, so that the toner images on the intermediate transfer belt T are secondarily transferred onto the paper sheet P.

The image former 4 uses the fixing apparatus F to heat and pressurize the paper sheet P onto which the toner images of the respective YMCK colors are secondarily transferred, and thereafter passes it through a predetermined carrying path to discharge it out of the machine.

The above is the series of image formation operations by the image former 4.

A destaticization apparatus 47 destaticizes residual toner remaining on the surface of the photoreceptor 41 after primary transfer. The destaticization apparatus 47 includes exposure means such as an LED, and has a function to completely delete a latent image before the next image formation so that the next image formation may be reliably performed.

A cleaning apparatus 48 removes residues such as residual toner and paper dust remaining on the surface of the photoreceptor 41 after primary transfer. The cleaning apparatus 48 adopts a blade cleaning system in which a cleaning blade in a flat plate shape (sheet shape) made of an elastic body (e.g., polyurethane rubber) is made to abut on the photoreceptor 41.

A belt cleaning apparatus 49 removes residues remaining on the intermediate transfer belt T after secondary transfer.

A lubricant application apparatus 100 is installed on the upstream side of the cleaning apparatus 48 in the advancing direction (rotation direction) of the photoreceptor 41, and not only applies (supplies) lubricant scraped off from a lubricant stick 102 onto the surface of the photoreceptor 41, but also recovers toner and an external additive remaining on the surface of the photoreceptor 41 after the toner images are transferred by the primary transfer roller 45.

Figure 4:
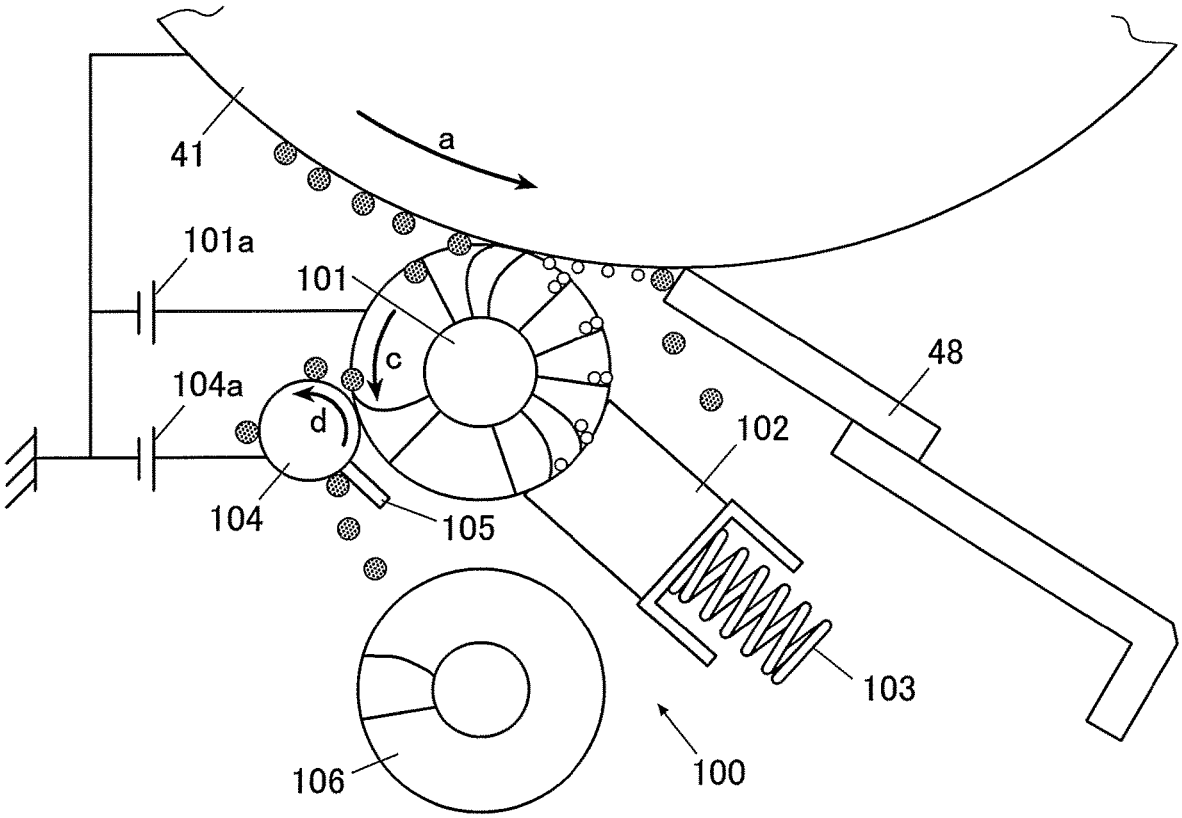
FIG. 4 is a diagram showing a schematic configuration of a lubricant application apparatus.

As shown in FIGS. 2 and 4, the lubricant application apparatus 100 is composed of an application brush 101 (application member), the lubricant stick 102, a pressing member 103, a recovery roller 104 (recovery member), a scraper 105, and a recovery screw 106.

The application brush 101 corresponds to the application member in the present invention, and is, for example, a roll-shape brush member obtained by winding a cloth in which polyester fibers are woven in a loop state around a metal shaft. The application brush 101 is set by an application brush driver 101*b* (see FIG. 3) so as to counter-rotate against rotation of the photoreceptor 41 at linear velocity slower than the photoreceptor 41. That is, it is set so that the surface of the application brush 101 may advance in a direction (the "c" direction in FIG. 4) opposite to that of the photoreceptor 41 in a contact portion between the application brush 101 and the photoreceptor 41.

In addition, the application brush 101 is installed so as to abut on both the lubricant stick 102 and the photoreceptor 41, and carries lubricant particles (lubricant powder) scraped off from the lubricant stick 102 to the photoreceptor 41 to supply the photoreceptor 41 with the lubricant powder. With respect to the rotation direction of the photoreceptor 41, the application brush 101 is installed on the downstream side of the developing apparatus 44 in the rotation direction of the photoreceptor 41, and on the upstream side of the cleaning apparatus 48 in the rotation direction of the photoreceptor 41.

Furthermore, the application brush 101 also recovers toner and an external additive remaining on the surface of the photoreceptor 41 after the toner images are transferred by the primary transfer roller 45. In addition, when supplying the lubricant powder to the photoreceptor 41, the application brush 101 also functions to apply in a spread manner the lubricant powder onto the photoreceptor 41 using abutting pressure on the photoreceptor 41.

The lubricant stick 102 is a solidification of powdery lubricant, and is selected from materials (e.g., zinc stearate) which are applicable to the surface of the photoreceptor 41, and can lower surface energy of the photoreceptor 41 to reduce adhesion between toner and the photoreceptor 41. The lubricant stick 102 is used by being formed in a shape which can be scraped off by the application brush 101 by melting and molding the above material, or compression-molding particles of the above material. Lubricant powder supplied to the surface of the photoreceptor 41 is formed into a film on the surface of the photoreceptor 41 by the cleaning apparatus 48 installed downstream of the application brush 101 to form a coating film. Since the coating film formed of zinc stearate has high releasability (that is, a high pure water contact angle) and a small friction coefficient, it has good transferability and cleanability, and can suppress depletion of the photoreceptor 41 to achieve a long life.

The pressing member 103 is, for example, a compression spring, and presses and holds the lubricant stick 102 against the application brush 101.

The recovery roller 104 corresponds to the recovery member in the present invention, is a roller made of metal such as stainless steel, and is set so as to counter-rotate against the application brush 101 by the recovery roller driver 104*b* (see FIG. 3). That is, it is set so that the surface of the recovery roller 104 advances in a direction opposite to that of the application brush 101 (the "d" direction in FIG. 4) in a contact portion between the recovery roller 104 and the application brush 101.

Note that residual toner recovered from the photoreceptor 41 to the application brush 101 is carried to the recovery roller 104 by rotation of the application brush 101. Then, the scraper 105 composed of a stainless steel plate abuts on the recovery roller 104, and scrapes away the residual toner carried and recovered onto the recovery roller 104.

The recovery screw 106 is composed to be rotatable in a predetermined direction by a driving apparatus not shown, and recovers and discharges toner removed by the scraper 105 and falling from above. The recovery screw 106 carries recovered toner to the developing apparatus 44 via a toner recycling apparatus not shown, or stores it in a waste toner box not shown.

As shown in FIG. 4, a brush bias $V_{BR}$ is applied to the aforementioned application brush 101 by a brush bias applicator 101*a* (first voltage applicator). In addition, a recovery bias $V_{FL}$ is applied to the recovery roller 104 by a recovery bias applicator 104*a* (second voltage applicator).

The paper feeder 5 is composed of the plurality of paper feeding trays 51-53, and stores different types of a plurality of paper sheets P in the respective paper feeding trays 51-53. The paper feeder 5 feeds a stored paper sheet P to the image former 4 through a predetermined carrying path.

The storage 6 is composed of an HDD (Hard Disk Drive), a semiconductor memory, or the like, and stores data such as program data and various setting data so that they can be read and written from the controller 10.

The operation and display part 7 is composed of, for example, a liquid crystal display (LCD) with a touch panel, and functions as a display 71 and an operation part 72.

The display 71 displays various operation screens, operation status of each function, and the like according to a display control signal input from the controller 10. In addition, it receives a touch operation made by a user to output an operation signal to the controller 10.

The operation part 72 includes various operation keys such as a numeric keypad, a start key, and the like, and receives various input operations made by the user to output operation signals to the controller 10. The user can operate the operation and display part 7 to make settings related to image formation such as image quality settings, magnification settings, application settings, output settings, and paper settings, a paper sheet carrying instruction, a stop operation for the apparatus, and the like.

The temperature and humidity detector 8 is composed of a temperature sensor, a humidity sensor, and the like, detects temperature and humidity in the enclosure of the image formation apparatus 1, and outputs a detection result to the controller 10.

The controller 10 is composed of a CPU, a RAM, a ROM, and the like, and the CPU deploys various programs stored in the ROM onto the RAM, and cooperates with the deployed various programs to comprehensively control operation of respective units of the image formation apparatus 1 such as the automatic document feeder 2, the scanner 3, the image former 4, the paper feeder 5, the storage 6, the operation and display part 7, and the temperature and humidity detector 8 (see FIG. 3). For example, the controller 10 receives input of an electric signal from the scanner 3 to perform various image processing, and outputs image data Dy, Dm, Dc, and Dk of the respective YMCK colors generated by the image processing to the image former 4. In addition, the controller 10 controls operation of the image former 4 to form an image on a paper sheet P.

[Applied Voltage of Lubricant Application Apparatus]

Subsequently, a method of controlling voltages applied to the application brush 101 and the recovery roller 104 of the lubricant application apparatus 100 according to this embodiment will be described with reference to the drawings.

The image formation apparatus 1 according to this embodiment is characterized by controlling each of removability of residual toner on the photoreceptor 41 by the application brush 101, and recoverability of toner adhering to the application brush 101 by the recovery roller 104.

Specifically, it executes a mode 1 (first mode) in which the removability and the recoverability are made relatively high to set the lubricant amount on the photoreceptor 41 to a relatively middle value, a mode 2 (second mode) in which the removability is made relatively high and the recoverability is made relatively low to set the lubricant amount on the photoreceptor 41 to a relatively high value, and a mode 3 (third mode) in which the removability is made relatively low and the recoverability is made relatively high to set the lubricant amount on the photoreceptor 41 to a relatively low value.

A difference between the brush bias $V_{BR}$ (first applied voltage value) and the recovery bias $V_{FL}$ (second applied voltage value) in the mode 1 is controlled to be larger than a difference between the brush bias $V_{BR}$ and the recovery bias $V_{FL}$ in the mode 2. In addition, the brush bias $V_{BR}$ in the mode 3 is controlled to be smaller than the brush biases $V_{BR}$ in the mode 1 and the mode 2.

More specifically, for example, the brush bias $V_{BR}$ is controlled to be switchable at two stages of 0 V and +400 V, and the recovery bias $V_{FL}$ is controlled to be switchable at three stages of +400 V, +600 V, and +1000 V. It is defined that a recovery potential difference $\Delta V=V_{FL}-V_{BR}$, and when $\Delta V=0$ V or 600 V, applied voltage in each mode is as follows.

$V_{BR}$=+400 V, $V_{FL}$=+1000 V($V_{FL}>V_{BR}>0$ V) Mode: 1

$V_{BR}$=+400 V, $V_{FL}$=+400 V($V_{FL}=V_{BR}>0$ V) Mode: 2

$V_{BR}$=0 V, $V_{FL}$=+600 V($V_{FL}>V_{BR}=0$ V) Mode: 3

The mode 1 will be described.

The developing apparatus 44 charges toner before transfer to negative polarity. Although residual toner is more destaticized than in a state immediately after development, it mostly has negative polarity. Therefore, most toner will be recovered by the application brush 101, and toner does not mostly reach the cleaning apparatus 48, so that polishing action in the cleaning apparatus 48 is small. In addition, toner recovered by the application brush 101 is recovered by the recovery roller 104. Since the application brush 101 scrapes the lubricant stick 102 in a clean state, lubricant consumption is limited. Lubricant powder scraped off from the lubricant stick 102 is carried to a rubbing portion of the application brush 101 with the photoreceptor 41 to be transferred to the photoreceptor 41. However, since the lubricant powder is charged with weak negative charge, there is some powder which does not move to the photoreceptor 41 due to the influence of the brush bias $V_{BR}$. The lubricant powder is recovered by the recovery roller 104 together with toner. As a result, the lubricant amount on the photoreceptor 41 is kept in an intermediate state among the three modes.

The mode 2 will be described.

It is similar to the mode 1 in that the application brush 101 recovers toner, and polishing action of the cleaning apparatus 48 is small. Since the recovery potential difference $\Delta V=0$ V, about a half of toner recovered by the application brush 101 is not recovered by the recovery roller 104. As a result, the action of scraping the lubricant stick 102 increases, and lubricant consumption increases. Furthermore, since lubricant powder which has not moved to the photoreceptor 41 is less likely to be electrically recovered also by the recovery roller 104, it is likely to be supplied to the photoreceptor 41 again. As a result, the lubricant amount on the photoreceptor 41 is kept in a large-amount state.

The mode 3 will be described.

Since the application brush 101 is less likely to recover toner, polishing action of toner having reached the cleaning apparatus 48 increases. Furthermore, since the recovery potential difference $\Delta V=600$ V, the application brush 101 is in a clean state, and lubricant consumption decreases. In addition, since lubricant powder is recovered by the recovery roller 104, the lubricant amount on the photoreceptor 41 decreases.

Figure 5:
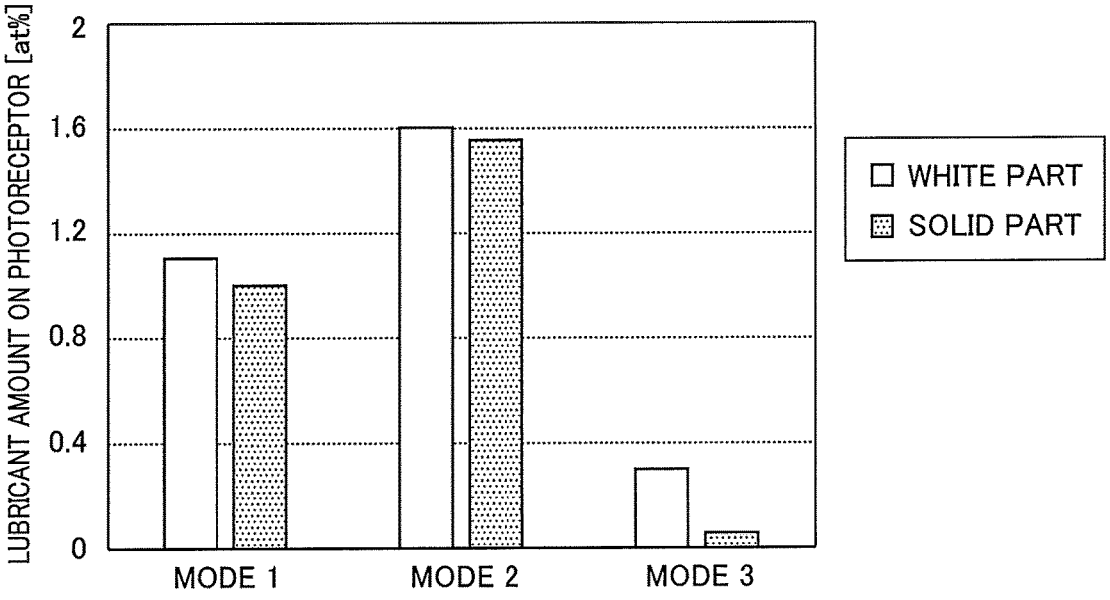
FIG. 5 is a diagram showing a lubricant amount on a photoreceptor in execution of each of a mode 1, a mode 2, and a mode 3.

FIG. 5 is a diagram showing the lubricant amount on the photoreceptor 41 in the case of operating the lubricant application apparatus 100 in each of the mode 1, the mode 2, and the mode 3. An evaluator having a configuration similar to those in FIGS. 1 and 2 (however, having no transferrer) is created for experiment, and shown is a result of measurement of the lubricant amount on the photoreceptor using ESCA in a case where the process velocity is 460 mm/s, the linear velocity of the application brush 101 is 460 mm/s (the linear velocity ratio $\theta=1.0$ with respect to the photoreceptor 41), the linear velocity of the recovery roller 104 is 69 mm/s (the linear velocity ratio $\theta=0.15$ with respect to the application brush 101), the evaluation environment is 10° C.×20%, and it is driven for 10 minutes. A white part is a part which is not exposed at all, a solid part is a part in a state of being exposed throughout, and about one third of the area in the longitudinal direction is set to a solid part. In addition, photoreceptor surface potential and development potential are adjusted so that the developed amount of the solid part may be almost the same toner amount as residual toner (about 0.2 g/m$^2$). It has been shown that the lubricant amount in the mode 1 has a middle value (about 1.0 at %), the lubricant amount in the mode 2 is larger than in the mode 1 (about 1.6 at %), and the lubricant amount in the mode 3 is smaller than in the mode 1 (0-0.3 at %).

Next, switching among the respective modes will be described.

Switching is performed from the mode 1 to the mode 2 depending on the states of the respective image formers YMCK, and switching is performed to the mode 3 depending on usage environment of the respective image formers YMCK irrespective of whether it is in the mode 1 or the mode 2. Switching from the mode 1 to the mode 2 is performed depending on driving time periods of the respective image formers YMCK and the remaining amount of the lubricant stick 102, and this switching is irreversible. In contrast, switching to the mode 3 is performed depending on absolute humidity around the respective image formers YMCK, this switching is reversible, and when the usage environment has returned to normal, the mode is returned to a state before switching (the mode 1 or the mode 2).

Switching from the mode 1 to the mode 2 will be described.

Since the cleaning apparatus 48 is less worn and has high cleaning ability in the first half of the life cycle of the respective image formers YMCK, slipping-through of toner can be suppressed even when the lubricant amount is small. In addition, although the cleaning apparatus 48 is worn by frictional force from the photoreceptor 41, normally an external additive deposited on a blade edge tip portion gradually slips through to reduce the frictional force received from the photoreceptor 41. However, when the lubricant amount is large, slipping-through of the external additive is extremely suppressed, and consequently the frictional force received from the photoreceptor 41 increases to progress blade wear. From this, it is effective for suppression of blade wear to initially reduce the lubricant amount by a certain degree.

On the other hand, the cleaning apparatus 48 is more worn in the latter half of the life cycle, and slipping-through of toner increases if the lubricant amount remains small. Since slipping-through of toner scrapes the lubricant layer of the photoreceptor 41 to further reduce the lubricant amount, it appears on the image as cleaning failure at once. From this, in the latter half of usage, by increasing the lubricant amount to suppress slipping-through of toner, it is possible to further extend the life of the respective image formers YMCK.

As means for estimating usage states of the respective image formers YMCK, it is possible to estimate them with a driving time period or the remaining amount of the lubricant stick 102. The driving time period represents the life of the respective image formers YMCK.

The driving time period can be obtained by accumulating operation time periods of a driving motor of the photoreceptor 41 in a memory. In addition, the number of printed sheets may be counted to control switching depending on the number of printed sheets.

The consumption of the lubricant stick 102 is also proportional to the driving time period. Detection of the remaining amount of the lubricant stick 102 is enabled by directly measuring its position. As the lubricant stick 102 is consumed, the position of a supporting metal plate not shown (a supporting member which supports the lubricant stick 102) gradually moves to approach the application brush 101. For example, by detecting the position of this supporting metal plate, the remaining amount of the lubricant stick 102 can be detected. In order to detect the position, a common displacement sensor may be used to continuously monitor the remaining amount, or a photosensor may be installed to notify that the consumption of the lubricant stick 102 has exceeded a predetermined consumption. Alternatively, pressing force of the lubricant stick 102 can be directly measured, and the force amount of the pressing member 103 can be directly measured. In this case, for example, it is enabled by installing a pressure sensor in a supporting part of the pressing member 103 (an end portion opposite to an end portion abutting on the lubricant stick 102). As the pressure sensor, a sheet-type one or a load cell can be used.

Switching to the mode 3 will be described.

Generally, the respective image formers YMCK in the case of applying lubricant reduce the depletion amount of the photoreceptor 41. Discharge products (nitrogen oxide) generated in the electrifying apparatus 42 adhere to the photoreceptor 41, and are ionized when combining with moisture in the air to become unable to sustain an electrostatic latent image, so that a seemingly blurred image, that is, so-called image deletion is generated. Although the discharge products are normally removed by the cleaning apparatus 48, even this discharge product cannot be removed when the depletion amount has decreased, and image deletion becomes likely to occur. Accordingly, in an environment in which image deletion is likely to occur, it is effective to reduce the lubricant amount.

An environment in which image deletion is likely to occur is a state with a large amount of moisture in the air, that is, a state at high absolute humidity. Especially, when the absolute humidity exceeds 20 g/m$^3$, the risk of occurrence of image deletion increases. By performing switching to the mode 3 in such a state, occurrence of image deletion can be suppressed. Since the absolute humidity is a function of temperature and humidity, it is possible by detecting temperature and humidity to perform control using a matrix of temperatures and humidities (as the temperature is higher and the humidity is higher, the absolute humidity is higher). In this embodiment, it is assumed to detect temperature and humidity by the temperature and humidity detector 8.

Figure 6:
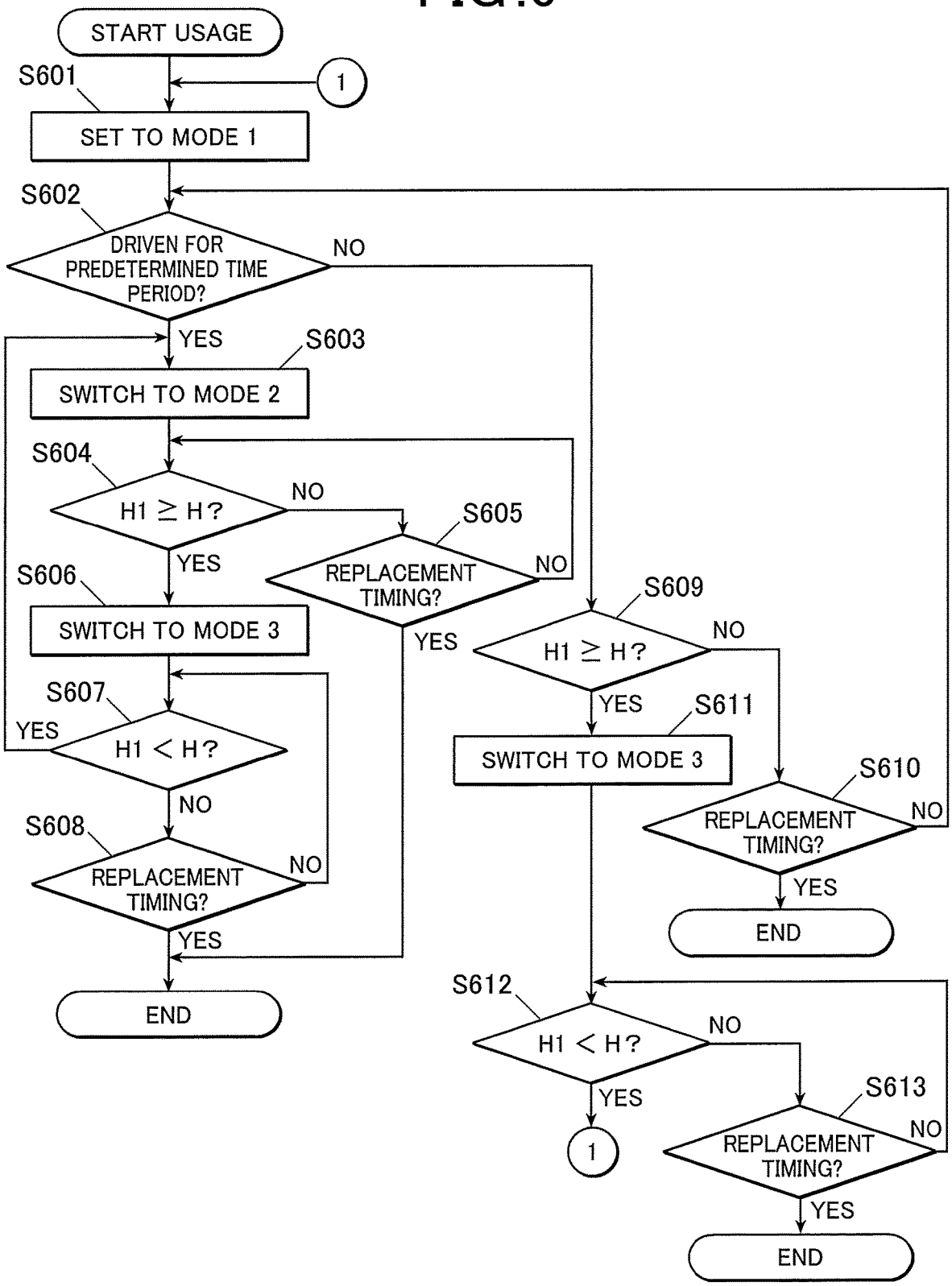
FIG. 6 is a flowchart showing operation of the image formation apparatus according to this embodiment.

Subsequently, operation of the image formation apparatus 1 according to this embodiment will be described using the flowchart in FIG. 6. In FIG. 6, it is assumed to start the use of the respective image formers YMCK from an initial state, that is, it is assumed to use, as the cleaning apparatus 48 and the lubricant stick 102, unused ones. Although a description is made taking the image former Y as an example here, similar description can be applied also to the image formers M, C, and K, and it is assumed to perform the following control on an individual image former separately.

Note that the operation of the image formation apparatus 1 in FIG. 6 is implemented by cooperation between the controller 10 and a program stored in the storage 6.

First, when the use of the image former Y is started, the controller 10 sets the brush bias $V_{BR}$ and the recovery bias $V_{FL}$ to voltages in the mode 1 (step S601).

Subsequently, the controller 10 determines whether the image former Y has been driven for a predetermined driving time period or not (step S602). The predetermined driving time period indicates a driving time period in which blade wear of the cleaning apparatus 48 progresses and slipping-through of toner is expected to occur as described above. When determining that it has been driven for the predetermined driving time period (step S603: YES), the controller 10 switches the brush bias $V_{BR}$ and the recovery bias $V_{FL}$ to the voltages in the mode 2 (step S603), but when determining that it has not been driven for the predetermined driving time period (step S603: NO), transitions to step S609.

Note that although timing of switching between the mode 1 and the mode 2 is determined based on the driving time period here, it can also be determined based on whether the consumption of the lubricant stick 102 has exceeded a predetermined consumption or not as described above.

After step S603, the controller 10 determines whether H1≥H or not (step S604). Here, H1 is absolute humidity calculated by the controller 10 based on temperature and humidity detected by the temperature and humidity detector 8, and H is a predetermined absolute humidity at which image deletion is expected to be likely to occur as described above. Note that the predetermined absolute humidity is stored in advance in the storage 6. When not determining that H1≥H (step S604: NO), the controller 10 transitions to step S605.

In step S605, the controller 10 determines whether replacement timing of each component of the image former Y has come or not. That is, the controller 10 determines whether blade replacement timing of the cleaning apparatus 48, replacement timing of the lubricant stick 102, or the like has come, and when determining that the replacement timing has come (step S605: YES), ends the control, but when determining that the replacement timing has not come (step S605: NO), returns to step S604.

In step S604, when determining that H1≥H, that is, that it is in a usage environment where image deletion is likely to occur (step S604: YES), the controller 10 switches the brush bias $V_{BR}$ and the recovery bias $V_{FL}$ to the voltages in the mode 3 (step S606).

After step S606, the controller 10 determines whether H1<H or not (step S607). When determining that H1<H, that is, that it is not in a usage environment where image deletion is likely to occur (step S607: YES), the controller 10 returns to step S603, but when not determining that H<H1, determines whether replacement timing has come or not (step S608). When determining in step S608 that the replacement timing has come (step S608: YES), the controller 10 ends the control, but when determining that the replacement timing has not come (step S608: NO), returns to step S607.

In step S609, the controller 10 determines whether H1≥H or not, and when not determining that H1≥H (step S609: NO), determines whether the replacement timing has come or not (step S610), and when determining that the replacement timing has come (step S610: YES), ends the control, but when determining that the replacement timing has not come (step S610: NO), returns to step S602.

In step S609, when determining that H1≥H (step S609: YES), it switches the brush bias $V_{BR}$ and the recovery bias $V_{FL}$ to the voltages in the mode 3 (step S611), and determines whether H1<H or not (step S612), and when determining that H1<H (step S612: YES), transitions to step S601, but when not determining that H1<H (step S612: NO), determines whether the replacement timing has come or not (step S613), and when determining that the replacement timing has come (step S613: YES), ends the control, but when determining that the replacement timing has not come (step S613: NO), returns to step S612.

As describe above, the image formation apparatus 1 according to this embodiment includes the lubricant application apparatus 100 including: the lubricant stick 102 obtained by solidifying powdery lubricant; the cleaning apparatus 48 which presses lubricant supplied to the photoreceptor 41 to form a film; the application brush 101 which supplies lubricant to the photoreceptor 41, and removes residual toner adhering to the photoreceptor 41; and the recovery roller 104 which recovers toner adhering to the application brush, and the controller 10 which controls the lubricant amount on the photoreceptor 41 by changing each of removability of the application brush 101, and recoverability of the recovery roller 104. Accordingly, since each of the removability and the recoverability can be independently controlled, it is possible by keeping the lubricant amount on the photoreceptor to an appropriate amount to ensure stable cleanability of the image former over a long period of time to achieve a long life.

In addition, the image formation apparatus 1 according to this embodiment includes: the brush bias applicator 101*a* which applies voltage to the application brush 101; and the recovery bias applicator 104*a* which applies voltage to the recovery roller 104, and the brush bias $V_{BR}$ and the recovery bias $V_{FL}$ are changed by the controller 10, so that the removability and the recoverability are changed, respectively. Accordingly, the lubricant amount can be adjusted without affecting rubbing force to the photoreceptor 41 of the application brush 101 as compared to a case of controlling the rotation velocity of the application brush 101 or the like.

In addition, the image formation apparatus 1 according to this embodiment executes any of the mode 1, the mode 2, and the mode 3, and performs control so that a difference between the brush bias $V_{BR}$ and the recovery bias $V_{FL}$ in the mode 1 may be greater than a difference between the brush bias $V_{BR}$ and the recovery bias $V_{FL}$ in the mode 2, and the brush bias $V_{BR}$ in the mode 3 may be smaller than the brush biases $V_{BR}$ in the mode 1 and the mode 2, thereby setting the removability and the recoverability to relatively high values in the mode 1, setting the removability to a relatively high value and the recoverability to a relatively low value in the mode 2, and setting the removability to a relatively low value and the recoverability to a relatively high value in the mode 3. Accordingly, by selecting any of the three modes, it is possible to adjust the lubricant amount depending on the situation.

In addition, the image formation apparatus 1 according to this embodiment performs switching from the mode 1 to the mode 2 when the driving time period of the respective image formers YMCK has exceeded the predetermined driving time period, or when the consumption of the lubricant stick 102 has exceeded a predetermined consumption. Accordingly, it is possible to suppress cleaning failure due to continuous usage of the image former to extend the life of the image former.

In addition, the image formation apparatus 1 according to this embodiment performs switching from the mode 1 or the mode 2 to the mode 3 when the absolute humidity around the respective image formers YMCK has exceeded the predetermined absolute humidity, and performs switching from the mode 3 to the mode 1 or the mode 2 when the absolute humidity has fallen below the predetermined absolute humidity. Accordingly, it is possible to effectively suppress image deletion by reducing the lubricant amount in an environment where image deletion is likely to occur such as under a condition of high temperature and high humidity.

Note that although it has been described in the above embodiment as a method of controlling the removability and the recoverability to mainly adjust applied voltages to the application brush 101 and the recovery roller 104, they are also controllable by changing the respective numbers of rotations in addition to this. Especially, when the rotation directions of the application brush 101 and the recovery roller 104 are "with" rotation (the surface of the recovery roller 104 advances in the same direction as the application brush 101 in a contact portion between the recovery roller 104 and the application brush 101), the removability and the recoverability can be largely adjusted based on the numbers of rotations in an area where the linear velocity ratio θ is equal to or greater than 1. Note that the numbers of rotations are changed by the application brush driver 101*b* and the recovery roller driver 104*b*, respectively.

For example, settings of the linear velocity ratio θ as follows are conceivable for the three modes. Note that the linear velocity ratio of the application brush 101 to the photoreceptor 41 is denoted as $\theta_{BR}$, and the linear velocity ratio of the recovery roller 104 to the application brush 101 is denoted as $\theta_{FL}$.

$\theta_{BR}=1.5, \theta_{FL}=1.5 (\theta_{FL}=\theta_{BR}>1.0)$ Mode: 1

$\theta_{BR}=1.5, \theta_{FL}=1.0 (\theta_{BR}>\theta_{FL}=1.0)$ Mode: 2

$\theta_{BR}=1.0, \theta_{F}=1.5 (\theta_{FL}>\theta_{BR}=1.0)$ Mode 3

In the mode 1, the linear velocity of the application brush 101 to the photoreceptor 41 is high, and the linear velocity of the recovery roller 104 to the application brush 101 is high, so that the removability and the recoverability have relatively high values. In the mode 2, the linear velocity of the application brush 101 to the photoreceptor 41 is high, so that the removability has a relatively high value, whereas the linear velocities of the application brush 101 and the recovery roller 104 are the same, so that the recoverability has a relatively low value. In the mode 3, the linear velocities of the photoreceptor 41 and the application brush 101 are the same, so that the removability has a relatively low value, whereas the linear velocity of the recovery roller 104 to the application brush 101 is high, so that the recoverability has a relatively high value.

Other Embodiments

Although specific description has been made based on an embodiment according to the present invention, the above embodiment is a preferable example of the present invention, and this is not limitative.

For example, although the photoreceptor 41 having pressure-sensitive conductive rubber on the surface is used in the above embodiment, this is not limitative. For example, it is also possible to use conductive rubber of electronically conductive type compounded with conductive particles such as carbon black, and since a resistance value changes due to a volume change of rubber also in this case, the effect of the present invention can be obtained.

In addition, although a configuration including the pressing member 103 which presses and holds the lubricant stick 102 against the application brush 101 has been exemplified and described in the above embodiment, this is not limitative. That is, the pressing member 103 is not an essential component for the present invention, for example, it is also possible to dispose the lubricant stick 102 above the application brush 101, and apply pressing force to the application brush 101 by the self-weight of the lubricant stick 102.

In addition, although the recovery roller 104 is used as the recovery member in the above embodiment, this is not limitative. For example, a configuration is also possible in which a metal plate such as a scraper is made to abut on the application brush 101, and voltage is applied to the metal plate. Although control based on the number of rotations of the application brush is impossible in this case, an effect similar to that of the above embodiment can be obtained by controlling voltages applied to the application brush 101 and the metal plate.

In addition, although a color image formation apparatus has been exemplified and described in the above embodiment in which four pairs of photoreceptors 41 and developing apparatuses 44 are prepared for the respective YMCK colors, and are caused to form images of the respective YMCK colors, which are overlaid on each other on the intermediate transfer belt T, this is not limitative. For example, the present invention is also applicable to a single-color image formation apparatus having only a pair of photoreceptor 41 and developing apparatus 44.

In addition, the present invention is also applicable to a direct transfer-type image formation apparatus in which the intermediate transfer belt T, the primary transfer roller 45, the secondary transfer facing roller 461, and the like are omitted, and a transfer is made on a paper sheet P directly from the photoreceptor 41.

In addition, each electrophotographic process technique conventionally used can be combined with any configuration according to the object of the image formation apparatus.

Although specific description has been made above based on an embodiment according to the present invention, also detail configuration of each apparatus composing the image formation apparatus and detail operation of each apparatus are changeable as appropriate within a range not departing from the spirit of the present invention.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-003071, filed on 12 Jan. 2018, is incorporated herein by reference in its entirety.

What is claimed is:

1. An image formation apparatus having a lubricant application apparatus which applies lubricant to an image carrier in an image former which forms a toner image, wherein the lubricant application apparatus comprises:

a lubricant stick obtained by solidifying powdery lubricant;

an application member disposed on an upstream side in an advancing direction of a surface of the image carrier with respect to a cleaning apparatus which presses lubricant supplied to the image carrier to form a film, the application member being for supplying lubricant scraped off from the lubricant stick to the image carrier and removing residual toner adhering to the image carrier; and a recovery member which is in contact with the application member, the recovery member being for recovering toner adhering to the application member, and the image formation apparatus comprises a hardware processor which controls a lubricant amount on the image carrier by changing each of removability of residual toner on the image carrier by the application member, and recoverability of residual toner on the application member by the recovery member.

2. The image formation apparatus according to claim 1, wherein the lubricant application apparatus comprises:

a first voltage applicator which applies voltage to the application member; and a second voltage applicator which applies voltage to the recovery member, and the hardware processor changes the removability and the recoverability by changing a first applied voltage value of voltage applied to the application member by the first voltage applicator, and a second applied voltage value of voltage applied to the recovery member by the second voltage applicator, respectively.

3. The image formation apparatus according to claim 2, wherein the hardware processor executes any of a first mode, a second mode, and a third mode in each of which the first applied voltage value and the second applied voltage value are set, a difference between the first applied voltage value and the second applied voltage value in the first mode is greater than a difference between the first applied voltage value and the second applied voltage value in the second mode, and the first applied voltage value in the third mode is smaller than the first applied voltage values in the first mode and the second mode.

4. The image formation apparatus according to claim 3, wherein the first applied voltage value is equal to $V_{BR}$, the second applied voltage value is equal to $V_{FL}$, and the first and second applied voltage values satisfy the following expressions (1), (2), and (3) in the first mode, the second mode, and the third mode, respectively:

$$\text{the first mode: } |V_{FL}|>|V_{BR}|>0V \quad (1)$$

$$\text{the second mode: } V_{FL}=V_{BR}>0V \quad (2)$$

$$\text{the third mode: } |V_{FL}|>|V_{BR}|=0V \quad (3).$$

5. The image formation apparatus according to claim 3, wherein the hardware processor performs switching from the first mode to the second mode when a driving time period of the image former has exceeded a predetermined driving time period.

6. The image formation apparatus according to claim 3, wherein the hardware processor performs switching from the first mode to the second mode when consumption of the lubricant stick has exceeded a predetermined consumption.

7. The image formation apparatus according to claim 3, wherein the hardware processor performs switching from the first mode or the second mode to the third mode when absolute humidity around the image former has exceeded a predetermined absolute humidity, and performs switching from the third mode to the first mode or the second mode when the absolute humidity around the image former has fallen below the predetermined absolute humidity.

8. The image formation apparatus according to claim 1, wherein in the lubricant application apparatus, the application member is an application brush which is in contact with the image carrier to rotate, and the recovery member is a recovery roller which is in contact with the application member to rotate, and the hardware processor changes the removability and the recoverability by changing the number of rotations of the application member and the number of rotations of the recovery member, respectively.

9. A non-transitory computer readable recording medium storing a program for causing a computer of an image formation apparatus comprising a lubricant application apparatus which comprises: a lubricant stick obtained by solidifying powdery lubricant; an application member which supplies lubricant scraped off from the lubricant stick to an image carrier, and removes residual toner adhering to the image carrier; and a recovery member which is in contact with the application member, the recovery member being for recovering toner adhering to the application member, the lubricant application apparatus being disposed on an upstream side in an advancing direction of a surface of the image carrier with respect to a cleaning apparatus which presses lubricant supplied to the image carrier to form a film, to control a lubricant amount on the image carrier by changing each of removability of residual toner on the image carrier by the application member, and recoverability of residual toner on the application member by the recovery member.

* * * * *